United States Patent [19]

Mamberer et al.

[11] 4,384,337

[45] May 17, 1983

[54] ZONAL INK DISTRIBUTION MEASURING METHOD AND SYSTEM

[75] Inventors: Hans E. Mamberer, Königsbrunn; Dieter Hirt, Augsburg, both of Fed. Rep. of Germany

[73] Assignee: M.A.N.-Roland Druckmaschinen Aktiengesellschaft, Offenbach am Main, Fed. Rep. of Germany

[21] Appl. No.: 212,119

[22] Filed: Dec. 2, 1980

[30] Foreign Application Priority Data

Dec. 15, 1979 [DE] Fed. Rep. of Germany ..... 2950650

[51] Int. Cl.[3] ..... B41J 33/00; B41C 7/08

[52] U.S. Cl. ..... 364/518; 364/550; 101/426

[58] Field of Search ..... 364/518, 519, 523, 525, 364/550, 551; 101/365, 350, 426

[56] References Cited

U.S. PATENT DOCUMENTS 3,835,777 9/1974 Krygeris ..... 101/365 X
4,200,932 4/1980 Schramm et al. ..... 364/519

FOREIGN PATENT DOCUMENTS 2618387 11/1977 Fed. Rep. of Germany .
2012213 7/1979 United Kingdom ..... 101/365
2024457 1/1980 United Kingdom ..... 101/365

*Primary Examiner*—Edward J. Wise
*Attorney, Agent, or Firm*—Frishauf, Holtz, Goodman & Woodward

[57] ABSTRACT

To avoid edge effects and local variations of differences in transducers across zones of material to be printed from which print control signals are to be derived, for example to control the localized or zone adjustment positions of a flexible doctor blade with respect to an ink ductor roller in an offset printing machine, a first standard sample providing, for example, white signals, is first scanned, then a standard sample, providing for example totally inked zones, is scanned, and then the actual printing sample. From each of the scannings, signals are derived with respect to print zones, for example columns in a newpaper layout, the signals being compared to form a difference or comparison signal from the first two standards (light and dark) in the respective zones, which difference signal is stored, with respect to the respective zones, in a file memory (11); this difference signal then is compared with processed transduced signals derived from the actual text to be printed, for conversion into output signals for display, storage or control of the printing machines in accordance with the respective ink coverage of the zones which were scanned.

14 Claims, 2 Drawing Figures

ZONAL INK DISTRIBUTION MEASURING METHOD AND SYSTEM

Figure 1:
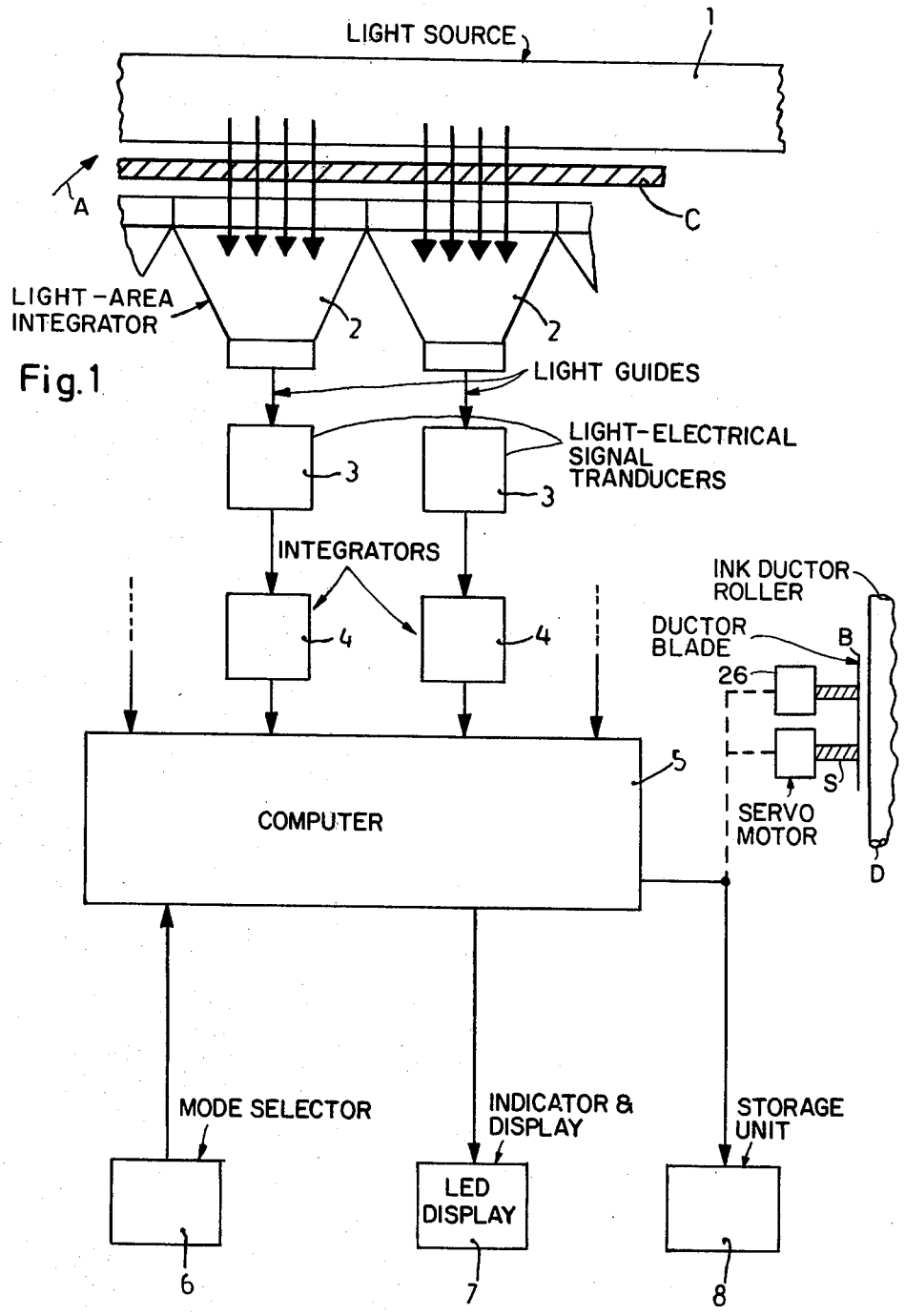

Reference to related application, assigned to the assignee of the present application: U.S. Ser. No. 185,414, filed Sept. 9, 1980, REES, now U.S. Pat. No. 4,325,303 U.S. Ser. No. 185,390, filed Sept. 9, 1980, REES, now U.S. Pat. No. 4,314,506 U.S. Ser. No. 06/212,039, filed Dec. 2, 1980, MAMBERER.

The present invention relates to apparatus to determine optical-electronically the ink coverage of offset printing machine plates or patterns or matrices from which plates can be made so that the brightness or, respectively, inking distribution can be determined. Optical receiving elements are used which converge brightness information of the pattern to be printed, as distributed in predetermined zones to a computer and evaluation apparatus in order to generate signals which can be stored or directly, in real time, applied to control the positioning of a doctor blade, or doctor blades, in respective coverage zones, on a ductor roller supplying ink to the plate cylinder of an offset printing machine.

BACKGROUND AND PRIOR ART

Various types of printing machine have ink ductor rollers which have doctor blades applied thereto, in which the engagement gap or nip of the doctor blade with respect to the ductor roller can be adjusted across the length of the ductor roller in respective zones. The doctor blade is flexible and, in some zones—distributed axially along the ductor roller—the ink film can be thicker than in others. The adjustment of the relative position of the doctor blade with respect to the ductor roller, which determines the thickness of the ink, can be done manually or automatically. The referenced REES application Ser. Nos. 185,414 and 185,390, both filed on Sept. 9, 1980, now U.S. Pat. Nos. 4,325,303 and 4,314,506 describe such apparatus. Electrical servo motors can be used to adjust the position of the adjustment screws by providing suitable control signals thereto.

Film scanning apparatus in order to determine the areal coverage of a film, particularly a film composite from which an offset printing plate is to be made, has been described in the literature—see German Patent Disclosure Document DE-OS No. 26 18 387. As disclosed therein, a light source is provided which passes light throughout its entire width through the film, the light then being sensed by a suitable receiving apparatus. The receiving apparatus is subdivided into a plurality of zones which are connected to an apparatus to evaluate the sensed values. The signals, so obtained, are then used to control the zone doctor blade adjustment screws in the inking fountain system of rotary offset printing machines. In this film scanning apparatus, the amplitude of the signals obtained by measuring the original in the various sensing zones is subject to different edge conditions and variations. These edge conditions are, for example, regions or zones of lesser light intensity of the illumination source towards the marginal regions, different influences of stray light and stray reflected light, manufacturing tolerances of the photoelectric transducers, and the like. It is important that, with the same object to be printed, and the same coverage relationships, that is, ink distribution relationships, the output signals should always be the same. To obtain this reproducibility of output requires frequent calibration. The apparatus of this type often uses integrators in order to eliminate erroneous readings which, then, have to be readjusted or recalibrated. Recalibration is time-consuming and can be carried out only for one specific element to be measured or sensed with its own specific characteristics of materials.

THE INVENTION

It is an object to provide an apparatus and a method for photoelectric measuring of areal coverage of a model or pattern, and to derive an evaluation signal, or signals, along predetermined zones, suitable to indicate and/or eventually control doctor blade adjustment screws, in which the influence of edge or margin conditions are automatically compensated, which can be rapidly and simply calibrated, and which does not require manual adjustment of the sensitivity or operating characteristics of integrators used in the equipment.

Briefly, the apparatus uses a a memory, a comparator, and a control section including a mode selector controlling the sequencing, or operation of the apparatus. The apparatus receives signals from a photoelectric transducer transducing signals from a first standard applied thereto which has minimum areal coverage of printed materials. The apparatus can use a computer which, in accordance with a transfer function relating the area coverage to doctor blade position—in respective zones—provides output values which can control doctor blade adjustment screws, or representative values which are stored. The process is then repeated with a second standard which contains, for example, maximum inking coverage. The output from the transducers, upon scanning the second standard, is subtracted from that of the first output to form a difference value which, again, is stored. The actual pattern or model, which is to be printed, is then introduced into the transducing system and the values derived therefrom are then compared in the comparator with the stored difference values previously determined. The so determined difference values are then used to provide an output which can be displayed or representative signals can be applied to directly control doctor blade adjustment screws; or they can be stored for later use to control adjustment screws, for example on magnetic tape, punched tape, floppy disks, or any other well known storage medium.

The system has the advantage that calibration is double calibration, first for minimum inking coverage and then for maximum inking coverage, and deriving a difference value which provides an artificial standard. Change-over between calibrating for light coverage and dark coverage thus is avoided, and can be, rather, carried out merely by introducing two different standard test or sensing models or patterns. The models or patterns, just as the test object itself, are measured in the apparatus, and the resulting difference signals then form the reference signals. Accordingly, any changes in sensitivity of respective transducers, illumination apparatus, and the like, will cancel automatically.

In accordance with a preferred form of the invention, the difference signals are converted from analog into digital form. The subdivision or number of steps of the digital signals which are stored in the memory, which preferably is a file memory, can be made equal to the number of the display elements of the display device which optically indicates the areal coverage of the pattern or model being tested. By comparison of the values derived from the actual model or pattern to be printed with the value stored in the file memory automatically eliminates any edge distortion or differences due to different sensitivity or response or the transducer elements and associated circuits and components. By suitable dimensioning of the respective memories, different values can be obtained for various types of standards, and patterns or models to be tested and respectively stored at allocated addresses. The versatility of the apparatus thus can be expanded merely with increased storage capacity.

DRAWINGS

Figure 2:
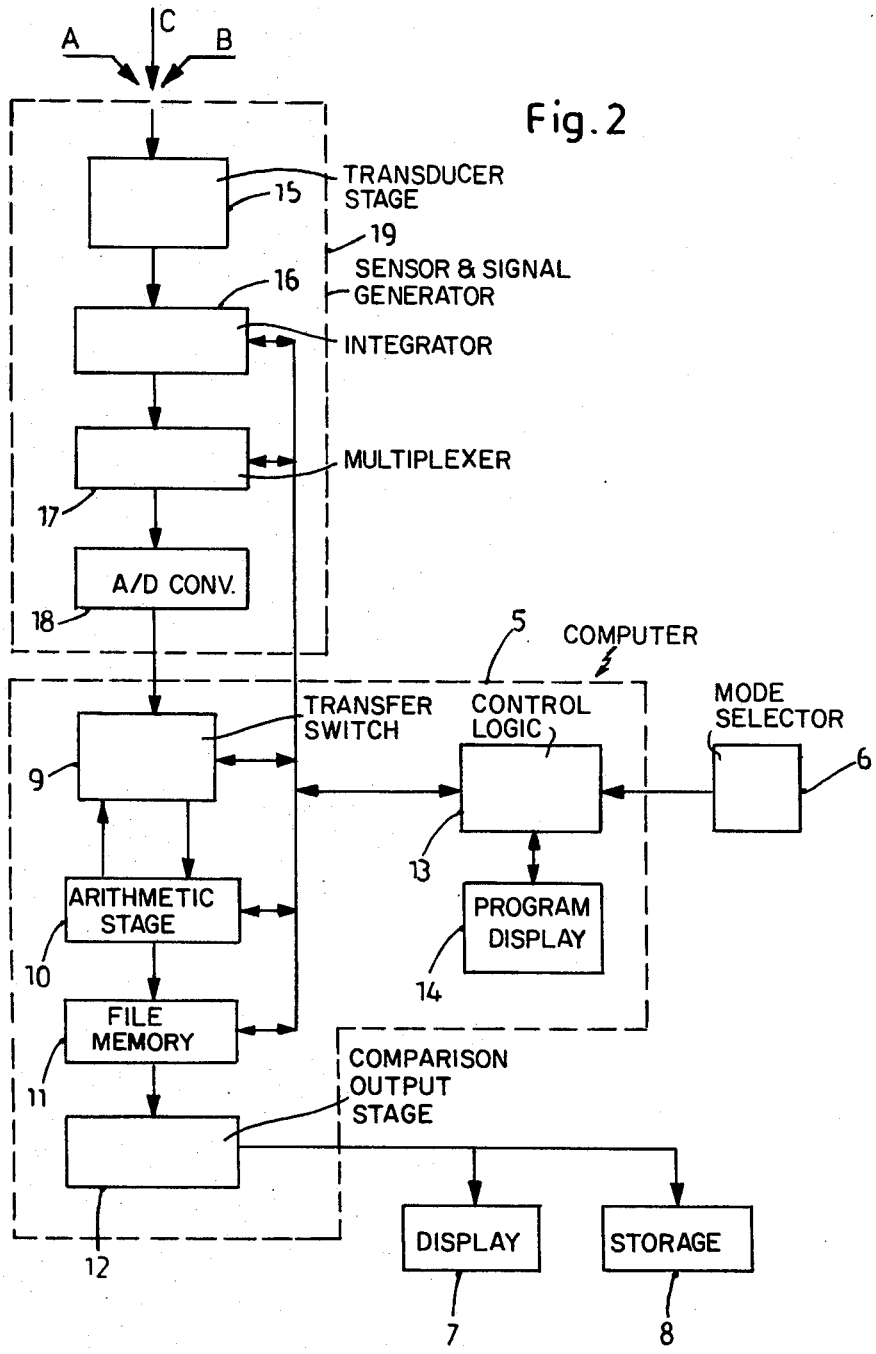

FIG. 1 is a highly schematic illustration of an apparatus in accordance with the invention; and FIG. 2 is a more detailed block circuit diagram illustrating the apparatus of FIG. 1 in greater detail and referred to in connection with the explanation of the method of the invention.

Referring first to FIG. 1: A test object C, for example a film transparency utilized to make an offset printing plate, is optically scanned in zones by passing light from a light source 1 therethrough. The test object C, for example, is a carrier with a surface thereon which, in zones, respectively inhibits or transmits more or less light, depending on printed subject matter placed thereon. Rather than using a transmitted light system, a reflected light system may also be used. A transport apparatus, schematically indicated by arrow A, and which may be any conventional and suitable roller transport, belt transport, and the like, moves the carrier C in a direction perpendicular to the plane of the drawing. A suitable transport may include a plurality of roller pairs which would be arranged ahead of and behind the drawing paper. During transport of the carrier C, the areal coverage thereon is scanned in zones, to obtain output signals representative of the brightness-darkness relationship thereof or thereon. The light derived from light source passes through the film carrier, is captured in a light-area integrator which may be an optical element, such as a cross section transducer, from which light is collected and applied over light guides to a photoelectrical signal transducer 3, for example in the form of photo diodes. The number of the receiving units, that is, the light-area integrators 2, placed transversely across the carrier C, will depend on its width, and the width of the respective zones which are to be tested or considered and, when applied to a printing apparatus, the number of doctor blade zone adjustment screws which are positioned transversely across a ductor roller picking up ink from an ink trough to convert relative darkness-brightness of the respective zones into relatively thicker or thinner ink film coverage on the ductor roller by relatively wider or narrower adjustment of the nip or gap between the doctor blade and the ductor roller.

The photo diodes 3 transform the received light intensity or light brightness electrical signals.

The signals derived from the photo diodes 3 are integrated, zone-by-zone, in an integrator 4 and applied to a computer 5 which is a suitable unit having arithmetic, comparison, memory and sequencing capability, useful in this apparatus and method. A mode selector 6 is connected to the computer 5. The mode selector 6 determines the operating mode of computer 5. The computer 5 is connected to the output units, such as an indicator and display which, preferably, is an LED (light-emitting diode) display or a storage unit, such as magnetic tape, floppy disk, or punched tape, to store utilization signals for subsequent use in a printing machine. Real-time control of adjustment screws for a doctor blade of a printing machine can also be obtained directly from the computer, for example by an output parallel to the storage unit 8, as indicated in broken lines in FIG. 1.

The mode selector 6 can control the operating mode of the computer, that is, whether the computer is to process and store signals internally when a standard carrier is introduced between light source 1 and the units 2—as will be described below—and to obtain difference signals. The mode selector can also be set to then cause the computer to compare an actual pattern or model carrying indicia to be printed with standard processed signals or, rather, difference signals derived therefrom, previously derived from the standard carriers which had been introduced into the system.

The system can be calibrated by first setting the mode selector 6 into a first calibration mode. Referring to FIG. 2, a first calibrating carrier A is introduced between the light source 1 and the elements 2. The standard carrier A has a first extreme, for example a minimum areal coverage of printed matter; in a limiting case, it can be entirely blank or "white". The light signals, in zones are sensed in the transducers 3, integrated in the integrators 4, and processed if necessary in the computer 5, and then temporarily stored in computer 5. Processing can be done in accordance with a well known transformation to transform the signals into suitable output control or utilization signals for respective servo motors 26 operating adjustment screws S which control the position of zones of the doctor blade B with with respect to the ink ductor roller D of a printing machine or only A/D conversion. After obtaining the processed signals from the respective transducers associated with the respective zones of the apparatus, scanning or reproducing the light transmitted by the light source with the white or first extreme value carrier A therein, another carrier substrate B (FIG. 2) is placed between the light source 1 and the light-area integrators 2. The second standard B has a coverage which is the other extreme, for example entirely covered with printed matter and, essentially, "black". Second transduced signals are then processed, as before, in the computer to derive second processed signals. The second processed signals are compared with, or subtracted from, the first processed signals to derive difference signals. The difference signals are stored in a memory, for example a file memory, associated with the respective zones of the transducing apparatus.

Upon introduction of the actual pattern matrix or model to be printed into the transducing apparatus, the relative black-white coverage thereon is compared with the difference signals which have been stored in the memory, typically the file memory, and, upon such comparison, the utilization signals are thus derived which are actually used to control the servo motors 26 for the screws S of the zones of adjustment of the doctor blade B, or for storage in the storage unit 8, for later use in a printing process. Of course, these signals can also be displayed on the display 7 which, preferably, displays the signals in an areal display showing the relative black/white coverage of the model or pattern, and the consequently required adjustment of the respective zone screws S so that, if desired, the zone screws S could also be adjusted manually.

FIG. 2 illustrates, in block form, the system in detail.

The computer 5 includes an input transfer switch 9, an arithmetic stage 10 functioning as a difference forming stage or comparator in which the aforementioned difference signals are determined upon first scanning the first A (e.g. white) standard, storing the signals, and then comparing with subsequently scanned "black" or B signals. The difference signals are converted into digital signals in an analog/digital converter (not shown) and of any suitable and well known type. The difference signals are stored in the file memory 11. The signals are stored with respect to the sensing or testing zones in respective file addresses. Upon then testing the actual model or object C which is to be printed, for example a film transparency layout, the signals derived from the respective zones are compared for the values in the respective zone stored in the file memory 11, and the then processed or computed utilization values for adjustment of the zone screws S in the comparator and output stage are applied to the display 7 and the storage 8 and, if desired, directly for real-time control of servo motors 26 (see FIG. 1).

The computer apparatus is controlled by a control logic 13 connected to a program memory 14. The program memory 14 is programmed to control the logic 13 to effect transfer of signals and storage in the respective file memories at respective addresses; this is a well known and simple program which can be carried out by a microprocessor. The mode selector 6 is connected to the control logic so that the proper program, as stored in program memory 14 is applied to the respective elements 9, 10, 11 and 12.

Signals applied to the transfer switch 9 are derived from the sensor and signal generator generally shown at 19 and including, generally, the elements 1–4 of FIG. 1. The sensor and signal generator 19 includes a transducer stage 15 which, in one block, schematically illustrates the combination of the light source 1 and the light-area integrator 2, between which a sample standard or a test sheet to be examined is placed, like the carrier C of FIG. 1. Stage 15 also includes the photoelectric or light-electrical signal transducers 3, all associated with respect to zones of the carrier C. Integrator 16, a multiplexer 17 and analog/digital converter unit 18 is connected to the transducer stage 15. Use of an analog/digital (A/D) converter 18 already at that stage permits application of digital signals to the computer 5, which substantially facilitates eventual computation in the computer. The signals derived from a first or light standard A (FIG. 2), a second or dark standard B, as well as from the test or sample to be printed, C, thus can be applied to the computer 5 already in digital form.

Computer 5, preferably, is a microprocessor, the operating mode of which is controlled by the mode selector 6, to change-over into a calibrating mode in which standards A and B of the carriers ae tested to derive a difference signal, or a second operating mode in which signals derived from an actual sample, model or carrier containing printing information, are analyzed for subsequent comparison with stored values in the file memory associated with the respective zones which are separately analyzed.

As can readily be seen, at the terminal end of the light source, for example, where the brightness may be less due to lack of light from the cross-over or a laterally adjacent zone, the signals derived from the standards will be different; the signals derived from the model or pattern to be printed will also be different from those of equal density in a central zone. Since the standard signals are formed as difference values, stored in the file memory 11, the actual adjustment values can be computed upon insertion of a sample C of material to be printed into the apparatus, already with respect to the accumulated light values when considering the end zones in relation to central zones.

Various changes and modifications may be made within the scope of the inventive concept.

As an example, the light source 1 could be an elongated fluorescent or other discharge tube illuminating a carrier C of the transparency type. The elements 2 can be glass or otherwise transparent blocks having a width covering the zone to be scanned and a length which is determined by the apparatus available. The light is collected centrally, guided by light guides to photoelectric diodes.

Suitable integrators, integrating the outputs from the diodes are:

Amplifier 741 Texas Instruments

Suitable A/D 18 converters 18 are: Teledyn, Intersil

A suitable microprocessor is: Motorola 6800, Intel 8080, Z80, Rockwell AIM

Such a microprocessor can be provided with an RAM file memory of max. 65 Kbyte capacity, for example of the type: Intel, Motorola The programming connection and the program memory for the microprocessor 5 can be in accordance with usually technology A suitable LED display 7 uses commercial LEDs from Texas Instruments A preferred storage unit 8 is: RAM-Motorola, magnetic tape, magnetic bubble memory, floppy disk

We claim:

1. Apparatus for electro-optical measurement of information coverage on zones of a surface of an areal carrier (C) and deriving corresponding representative utilization signals, particularly for control of ink zone adjustment means (26, S) in a printing apparatus (B, D), in which the distribution of the degree of inking of zones of the surface area is determined, having electro-optical transducing means (1, 2, 3, 4, 19) providing en electrical signal representative of the relative distribution of ink in the respective zones of the surface area, and comprising, in accordance with the invention, a memory (11, a comparator (10, 12) and control means (6, 13, 14) including a selector controlling the sequencing of comparison, and storage of signals, said memory and comparator being connected to and receiving signals from said transducing means covering respective zones, and processing said signals, upon introduction of the carrier with the surface into the transducing apparatus to derive therefrom and provide said utilization signals applicable to respective zones, said memory and comparator being connected and arranged for (a) upon selection of a first calibrating mode and upon introduction of a first standard surface (A) having a first extreme value of ink covering into the transducer means, receiving first transduced signals transmitted by the transducer means, and storing said first received signals;

(b) upon selection of a second calibrating mode and upon introduction of a second standard surface (B) having an opposite and second extreme value of ink covering into the transducer means, receiving second transduced signals transmitted by the transducing means, and comparing with said stored first transduced signals to form a difference of the second transduced signals with respect to said stored first transduced signals to derive difference signals, and storing said difference signals in the memory (11); and (c) upon selection of a third or controlled operating mode and introduction of a carrier having a surface (C) carrying indicia intended for printing into the transducing means, receiving third transduced signals transmitted by the transducing means to derive operating transduced signals, and comparing the signals for the respective zones covered by the zones of the surface in the transducing means in said comparator (12) with said stored difference signals of the respective zones in the memory (11) to derive utilization signals;

output means (7, 8, 26) for receiving said utilization signals;

and sequencing control means (13, 14) controlling said memory (11) and comparator (10, 12) for selectively receiving and storing the respective signals applied thereto.

2. Apparatus according to claim 1, wherein said standard surfaces (A, B) cover all said zones.

3. Apparatus according to claim 1, further including an analog/digital converter (18) receiving the transduced signals in analog form and converting said signals into digital form for comparison and storage in said comparator (10, 12) and memory (11).

4. Apparatus according to claim 1, further including light-area integrators coupled to receive light from the carrier (C) and scanning said carrier in the respective zones.

5. Apparatus according to claim 1, wherein the storage capacity of the memory (11) is of sufficient capacity for storing utilization signals, respectively, for a plurality of areal carriers having, respectively, different printing indicia applied thereto.

6. Apparatus according to claim 1, wherein the output means comprises a light-emitting diode (LED) display.

7. Apparatus according to claim 1, wherein the output means includes a long-term storage means storing representations of utilization signals.

8. Apparatus according to claim 1, wherein the memory (11), the comparator (10, 12), and the sequencing control means comprises a microprocessor.

9. Method of deriving utilization signals representative of the information coverage on zones of a surface of an areal carrier (C), particularly for control of ink zone adjustment means (26, S) in a printing apparatus (B, D), for determination of the distribution of the degree of inking of zones of the surface area, using electro-optical transducing means providing electrical signals representative of the relative distribution of ink in the respective zones of the surface of the carrier, and memory, difference forming, and comparison apparatus including a selector controlling the sequencing of the steps, the memory (11) providing storage of signals, and, comprising the steps of introducing a first standard surface (A) having a first extreme value of ink covering into the transducer means and deriving first transduced signals;

applying said first transduced signals to the memory; storing said first transduced signals;

introducing a second standard surface (B) having an opposite and second extreme value of ink covering into the transducer means and deriving second transduced signals;

forming a difference signal of said second transduced signals with respect to said stored first transduced signals, and storing said difference signals in the memory (11);

introducing a carrier having a surface carrying indicia intended for printing into the transducing means and deriving third transduced signals;

comparing said third transduced signals with said stored difference signals in the memory, with respect to the respective zones covered by the zones of the surface in the transducing means by comparing, in a comparator, the third transduced signals for the respective zones with said stored difference signals of the respective zones;

and deriving an output signal representative of the result of said comparison.

10. Method according to claim 9, wherein said step of deriving the output comprises storing the output signals, with respect to the respective zones in a long-term memory.

11. Method according to claim 9, wherein said step of deriving an output comprises displaying a representation of said output signals in an areal display.

12. Method according to claim 9, wherein said step of deriving an output comprises controlling said ink zone adjustment means (26, S) by said output signal.

13. Method according to claim 9, including the step of digitizing the transduced signals derived from said transducing means prior to storing said signals.

14. Method according to claim 9, further comprising the step of introducing, sequentially, various carriers having different surface coverage of the respective zones into the apparatus and repeating said steps of deriving the third transduced signals to obtain further third transduced signals; and comparing the further third transduced signals with said stored difference signals, relative to said zones, for each of said various carriers;

and the step of deriving an output signal comprises storing the respective output signals derived from the various carriers in relation to the zones thereon on a long-term storage means.

* * * * *